US005349142A

United States Patent [19]

Hasegawa

[11] Patent Number: 5,349,142

[45] Date of Patent: Sep. 20, 1994

[54] ENERGY CONSERVATION TYPE HYDRAULIC ELEVATOR AND SPEED CONTROL METHOD OF HYDRAULIC ELEVATOR

[75] Inventor: Fuminori Hasegawa, Tokyo, Japan

[73] Assignee: Kaisei Kogyo K.K., Tokyo, Japan

[21] Appl. No.: 978,462

[22] Filed: Nov. 19, 1992

Related U.S. Application Data

[62] Division of Ser. No. 584,044, Sep. 18, 1990, abandoned.

[30] Foreign Application Priority Data

Apr. 25, 1990 [JP] Japan ..... 2-109803

[51] Int. Cl.[5] ..... B66B 9/04

[52] U.S. Cl. ..... 187/110; 187/29.2; 187/68

[58] Field of Search ..... 187/110, 111, 68, 69, 187/70, 94, 29.2

[56] References Cited

U.S. PATENT DOCUMENTS

| | | | |
|---|---|---|---|
| 449,662 | 4/1891 | Baxter, Jr. | 187/110 |
| 1,208,451 | 12/1916 | Baldwin et al. | 187/68 |
| 2,417,947 | 3/1947 | Reedy | 187/110 |
| 4,351,415 | 9/1982 | Kita | 187/29 B |
| 4,474,266 | 10/1984 | Kallis | 187/29 A |
| 4,489,812 | 12/1984 | Ferris | 187/29 R |
| 4,593,792 | 6/1986 | Yamamoto | 187/29 B |
| 4,761,953 | 8/1988 | Rosman | 60/414 |
| 4,807,724 | 2/1989 | Martin | 187/110 |

*Primary Examiner*—R. Skudy
*Assistant Examiner*—Adolf Berhane
*Attorney, Agent, or Firm*—Oblon, Spivak, McClelland, Maier & Neustadt

[57] ABSTRACT

In the energy conservation type hydraulic elevator, a load carrying elevator and a balancing elevator are each provided on a respective hydraulic cylinder. The hydraulic cylinders are connected to one another by a fluid circuit. The balancing elevator is weighted so as to minimize the power input required of a hydraulic pump in the fluid circuit. In the speed control method of a hydraulic elevator, a negative pressure is first produced in a fluid path connecting a hydraulic pump and a control valve so that oil is drawn into the fluid flow path from an oil tank by way of a nonreturn valve. Descent of the elevator is then permitted to start by opening a control valve, allowing hydraulic fluid to flow from a cylinder, by way of a hydraulic pump, to an oil tank. The hydraulic pump and a motor rotate with the hydraulic fluid, and the motor is rotated at a synchronous number of revolutions by switching on an inverter power source when the number of revolutions has reached the synchronous number of revolutions of the motor.

12 Claims, 4 Drawing Sheets

ENERGY CONSERVATION TYPE HYDRAULIC ELEVATOR AND SPEED CONTROL METHOD OF HYDRAULIC ELEVATOR

This application is a division of application Ser. No. 07/584,044 , filed on Aug. 18, 1990, now abandoned.

BACKGROUND OF THE INVENTION

The present invention relates to a hydraulic elevator with which the energy efficiency on operation is enhanced. Moreover, the invention is concerned with an improved control method of an elevator, particularly, with a speed control method of a hydraulic elevator using an inverter power source for a more comfortable ride in the elevator.

Among conventional hydraulic elevators are those shown in FIGS. 2 and 3. In the elevator shown in FIG. 2, a ram (15) provided with a cage (2) for carrying persons and/or burdens at its upper end is inserted into a hydraulic cylinder (16) and the working fluid (X) is flown-in from an oil tank to the hydraulic cylinder (16) or flown-out from the hydraulic cylinder (16) to the oil tank by a hydraulic pump not shown in the diagram to move the cage (2) up or down. In the elevator shown in FIG. 3, the upper end of a cage (2) for carrying persons and/or burdens is attached to one end of wire (17) and a weight (19) is attached to the other end through pulleys (18) to pull the cage (2) upward by the weight of weight (19) in the case of ascending cage (2), thus to alleviate the load on a hydraulic pump by a portion of pressure corresponding to the tension, or the like.

In the case of the hydraulic elevator shown in FIG. 2, however, the power factor, that is, the required power of hydraulic pump-driving motor when ascending said elevator at a speed V can be expressed by the following formula, where A is the weight of cage (2), B is the weight of ram (15) and W is the maximum burden weight.

$$(A+B+W)\times V \quad (1)$$

Since overall load is applied as it is as a load in this way, a large-capacity motor is required and further the temperature rise of working fluid is also significant.

Moreover, in the case of hydraulic elevator shown in FIG. 3, required power when ascending said elevator at a speed V is expressed by the following formula, where Z is the weight of weight (19).

$$(A+B+W-Z)\times V \quad (2)$$

The load of the motor in formula (2) becomes lower over the formula (1) permitting the use of a motor with a relatively small capacity. However, since weight (19) is retained by the building, the structure of the building must be of a large scale or include strong reinforcement.

Furthermore, when descending these hydraulic elevators, it is common to construct a circuit allowing working fluid from the cylinder to pass through a throttle valve and to return to the oil tank under control of speed by the self-weight of elevator. In the case of hydraulic elevator shown in FIG. 3, however, this works effectively only when the weight (Z) of weight (19) is lighter than the total weight (W +A+B) of burden weight, cage and ram.

As a result of extensive investigations in view of this situation, an energy conservation type hydraulic elevator having solved these problems has been developed by the invention.

Moreover, in a conventional hydraulic elevator, a three-phase induction motor (hereinafter referred to as motor) was combined with the hydraulic pump and the working fluid was transported from the oil tank to the cylinder by the hydraulic pump and conversely from the cylinder to the oil tank by a hydraulic directional control valve to allow the elevator to move up and down. In this method, the speed control of the hydraulic elevator was performed by directionally controlling the flow rate of working fluid with a pilot directional control valve. With such a control method, however, there is room for improvement because the elevator is uncomfortable when it starts to descend, the elevator vibrates significantly on acceleration, and further the temperature rise of working fluid also becomes high.

Hence, a method of controlling the speed of elevator, wherein the number of revolutions of a motor is changed by changing the frequency of power source to the motor using an inverter control power source, and others have been adopted so far, but the problems aforementioned could not be said to have been enough solved.

As a result of extensive investigations in view of this situation, a speed control method has been developed by the invention, wherein a highly smooth, comfortable ride can be achieved without giving a large shock to the elevator upon starting descent of the elevator and wherein the comfortableness on descending arrival at the floor is improved.

SUMMARY OF THE INVENTION

An energy conservation type hydraulic elevator according to the invention provides an energy conservation type hydraulic elevator comprising a communicating path communicating respective cylinders of a main elevator, which allows a ram mounted with a cage for carrying persons and/or burdens to move up and down by flowing-in or flowing-out the working fluid to or from a main cylinder, and a balance elevator including a ram mounted with a fixed weight and a subcylinder. The main cylinder and subcylinder are communicated with one another via a first hydraulic pump. The pressure difference between the hydraulic pressure in the communicating path on the side of the main elevator and that in the communicating path on the side of the balance elevator are kept small by mounting an adjusting weight with about half of the maximum burden weight on the fixed weight. An emergency descent valve is provided for discharging the interior working fluid to the communicating path on the side of the main elevator. A second hydraulic pump is provided for modifying the relative positions of the main cylinder and the subcylinder by supplying the interior working fluid to the communicating path on the side of balance elevator. When the burden weight of the main elevator is larger than the adjusting weight, the working fluid is fed from the subcylinder of the balance elevator to the main cylinder of the main elevator by driving the hydraulic pump provided in the communicating path on ascent of the main elevator. Flowing the working fluid in the main cylinder through the communicating path to feed into the subcylinder allows the main elevator to descend by its self-weight and rotate the hydraulic pump and motor by flowing working fluid on descent of main elevator. When the burden weight of the main elevator is smaller than the adjusting weight, the working fluid in the subcylinder is flown through the communicating path to feed into the main cylinder by allowing the balance elevator to descend by its self-weight and the hydraulic pump and motor are rotated by flowing working fluid on ascent of main elevator. A hydraulic circuit is formed for feeding the working fluid from the main cylinder to the subcylinder by driving the hydraulic pump in the communicating path on descent of the main elevator. The elevator further includes a device for inverter-controlling the motor for driving the hydraulic pump.

Moreover, a speed control method for a hydraulic elevator using an inverter power source in the hydraulic elevator is disclosed. In a ram-unified elevator made to move up and down by feeding the working fluid from an oil tank into a cylinder via a control valve by a hydraulic pump and conversely by returning the working fluid from the cylinder to the oil tank via the control valve and the hydraulic pump, where the flow path of working fluid connecting the control valve and the hydraulic pump is communicated to the oil tank via a nonreturn valve, and the motor driving the hydraulic pump is controlled by an inverter power source and its control device, the method includes the steps of: making the pressure inside the flow path negative by driving the motor for a given time and by working the hydraulic pump in the direction of returning the working fluid to the oil tank in order to decrease the starting resistances of the motor and the hydraulic pump at the time of descending start of elevator; then applying pressure to the flow path by opening the control valve and by flowing-in the working fluid from the cylinder to the flow path and the hydraulic pump; returning concurrently the working fluid to the oil tank; allowing the hydraulic pump and the motor to rotate with this return working fluid; detecting concurrently the number of revolutions of the motor with a detector of number of revolutions mounted on the motor; and allowing the motor to rotate at the same number of revolutions as a synchronous number of revolutions by switching-on the inverter power source when the number of revolutions has reached the synchronous number of revolutions of the motor.

DETAILED DESCRIPTION OF THE INVENTION

Figure 1:
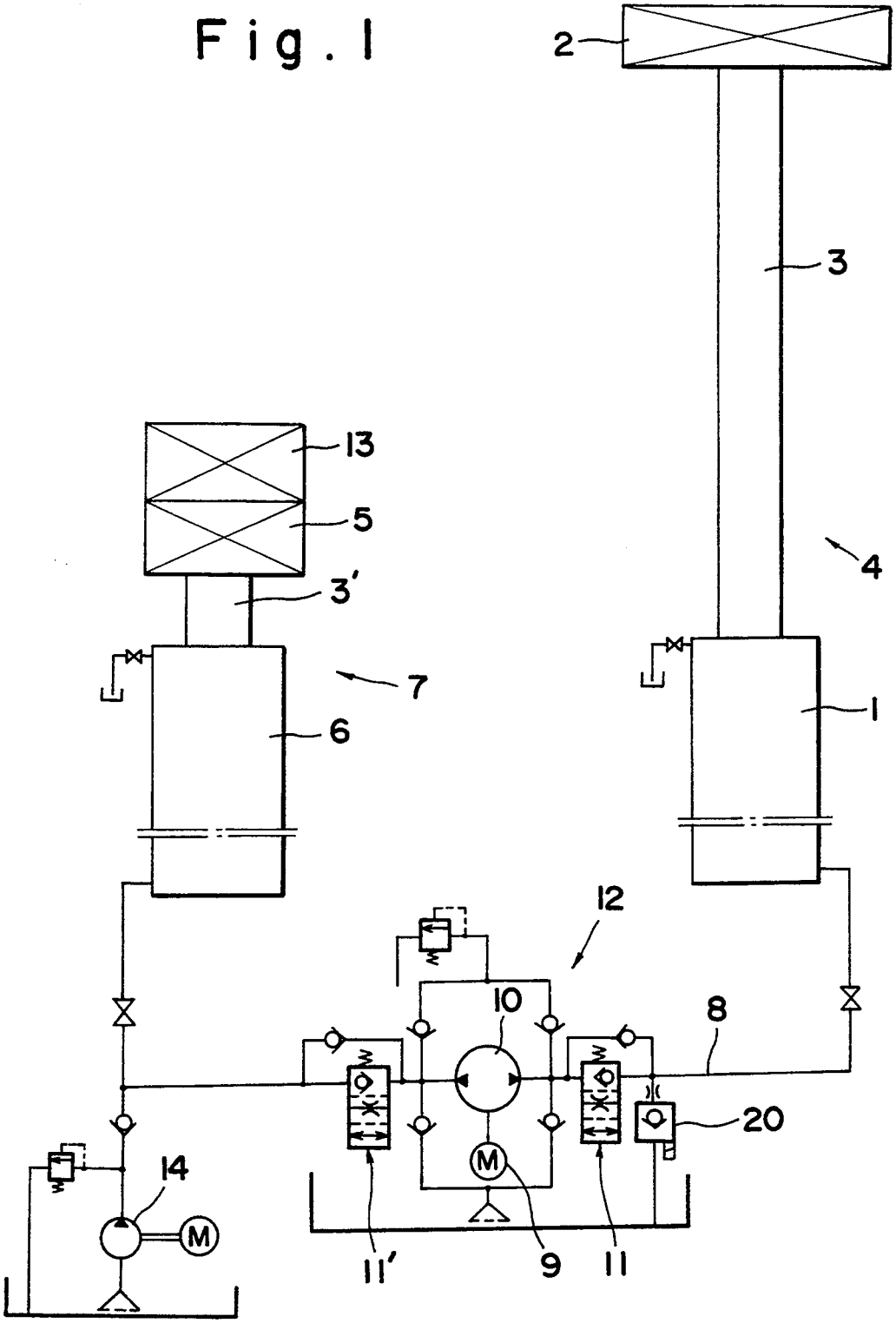
FIG. 1 is an illustration diagram showing one example of an energy conservation type hydraulic elevator.

In the first invention (the energy conservation type hydraulic elevator), the reason why an adjusting weight with about half of the maximum burden weight (W) of the main elevator is attached to the fixed weight of the balance elevator is because the pressure difference between hydraulic pressure in the communicating path on the side of main elevator and that in the communicating path on the side of balance elevator is made small. When allowing the main elevator to ascend in a state of no persons and/or no carrying burdens in the cage of the main elevator, the load on the side of the balance elevator is larger by about $\frac{1}{2}$W. Hence, by communicating the cylinders of both elevators and by descending the balance elevator by its self-weight, the main elevator is pushed up at a pressure corresponding to about $\frac{1}{2}$ W. So, the hydraulic pump is unnecessary in this case. Namely, this is because the electric energy for driving the hydraulic pump becomes unnecessary. Yet, since the hydraulic pump is rotated at this time with the working fluid flowing through the communicating path, there is an advantage that the motor acts as a generator and the power is recycled to inverter. By performing such recycling control, this recycled power is accumulated in the condenser provided in the D.C. circuit inside the inverter. When this increases, the power can be collected with external damping resistance unit etc. as a thermal energy for multi-purpose demands such as hot water supply, heating, etc. or for releasing outside the room, which is an advantage.

On the other hand, when allowing the main elevator to descend in this state, the working fluid in the main cylinder pressurized with the weight of the cage and that of ram of the main elevator is fed into the subcylinder of the balance elevator adding a pressure corresponding to about $\frac{1}{2}$W by the hydraulic pump. By working in this way, the balance elevator ascends at the same speed (V) as the descending speed of the main elevator. Namely, the required power for the motor in this case becomes approximately as follows:

$$\tfrac{1}{2}W \times V \qquad (3)$$

Therefore, there is an advantage that it is possible to operate with a motor with much smaller capacity over formula (1) and (2) aforementioned.

Moreover, conversely, when allowing the main elevator to ascend in a state of adding the maximum burden weight (W) to the main elevator, on the contrary to above, the load on the side of main elevator becomes larger by about $\frac{1}{2}$W. Thus, the working fluid in the subcylinder pressurized with the weight of the adjusting weight, that of the fixed weight and that of the ram of the balance elevator is fed into the main cylinder of the main elevator adding a pressure corresponding to about $\frac{1}{2}$W by the hydraulic pump to ascend the main elevator and, at the same time, to descend the balance elevator. The required power for the motor driving the hydraulic pump in this case is expressed similarly to formula (3), where the ascending and descending speed of the elevator is V, resulting in a significant energy conservation.

On the other hand, when allowing the main elevator to descend in this state, by communicating the cylinders of both elevators and by descending the main elevator by its self-weight, the balance elevator can ascend at the same speed as the descending speed of the main elevator. So it is unnecessary to drive the hydraulic pump and further the recycled power can be utilized as above, which are advantages.

As described, the weight of the adjusting weight of the balance elevator is common to be about half of the maximum burden weight. This weight should be established to be the most effective value from the aspect of efficiency so that the pressure difference between the communicating path on the side of the main elevator and that on the side of the balance elevator becomes small as a whole depending on the actual situation of use.

In addition, since the emergency descent valve is provided in the communicating path on the side of the main elevator, there is an advantage that, even at the time of breakdown of the balance elevator or the hydraulic pump, the main elevator can descend irrespective of these.

Further, since the modifying hydraulic pump can supply leaked working fluid to the subcylinder, there is a feature that the relative position of the balance elevator to the main elevator can be retained always constantly.

Moreover, since the power of the motor also becomes lower compared with conventional ones as shown in formula (3), a small capacity motor can be employed leading to a cheap cost of electric installations.

Furthermore, since the delivery of working fluid can be performed only in both cylinders and the oil tank for storing working fluid is enough to be very small, there is an advantage spatially. Also, since the heat generation of working fluid is low, the required amount of oil may be less.

Still more, since the balance elevator can be installed in a dead space of a building, there are features that new space is unnecessary and such structure as retains the weight by building as conventional one is also unnecessary. Still more, since the power source of the drive motor is under inverter control, the uncomfortableness to ride in by a shock during the acceleration of an ordinary elevator can be solved by the speed control (see Japanese Patent Application No. Sho 62-152784). Besides, it is also possible to use an ordinary variable pump not provided with an inverter.

Figure 7:
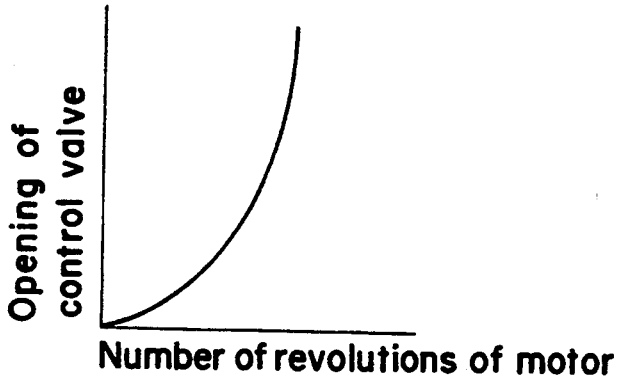
Fig. 7 (PRIOR ART)
FIG. 7 is a chart showing the relationship between the opening of the control valve and the number of revolutions of the motor at the time of hydraulic elevator moving down.

In the second invention (the speed control method), at the time of elevator moving down, the working fluid in the cylinder returns to the oil tank via a control valve and further via a hydraulic pump by opening the control valve below the cylinder. At this time, the return oil, rotates the hydraulic pump and the motor connected to the hydraulic pump. The relationship between opening of the control valve and the number of revolutions of the motor at a given time is as shown in FIG. 7. As the opening increases, that is, with the lapse of time, the number of revolutions of the motor gradually increases with return oil. But, when the opening of the valve becomes large due to the acceleration of the descending elevator, not a little shock occurs on start, if the flow of return oil is not synchronized with the frequency of inverter.

For this reason, when the number of revolutions of the motor is arbitrary before reaching full-speed descent by opening the control valve, the motor is forcedly rotated at the same number of revolutions as said number of revolutions by means of an inverter power source. By doing so, the amount of working fluid to return to oil tank per unit time does not depend on the opening of valve, but becomes constant resulting in that the descending speed of the elevator can be controlled by the number of revolutions of the motor.

Figure 4:
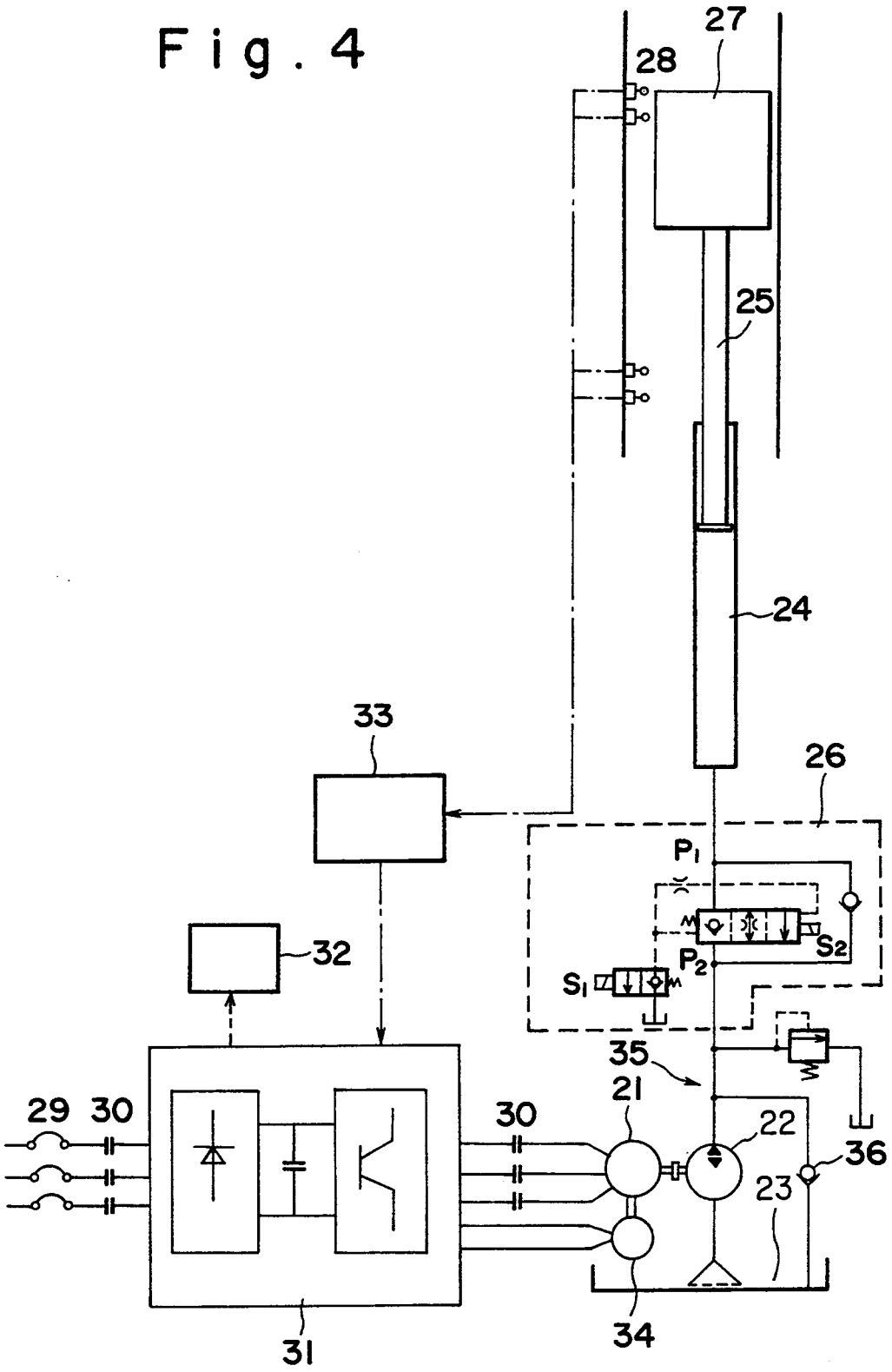
FIG. 4 is an illustration diagram showing a hydraulic elevator and a speed control device by means of an inverter power source.

Conventional improved speed control by means of inverter power source has a constitution as above, but, even in this case, the comfortableness to ride in before-starting in the inverter control cannot be said to be enough. This is particularly due to the higher starting resistances of the motor and the hydraulic pump, resulting in that these become difficult to start For this reason, in the invention, the motor power source is switched-on before starting in the inverter control and further before opening control valve and, as shown in FIG. 4, the hydraulic pump (22) is rotated in the direction of working fluid in the flow path (35) connecting hydraulic pump (22) and control valve (26) returning to oil tank (23) to eliminate the starting resistance, and, in a little time thereafter, the motor power source is switched-off. Since, by this procedure, the pressure inside the flow path (35) becomes negative, the working fluid in the oil tank (23) is supplied to the flow path (35) via a nonreturn valve (36), and returns again to the oil tank (23) via hydraulic pump (22) for circulation. Then, the working fluid in the cylinder (24) is flown into the flow path (35) by opening control valve (26) to apply a pressure to the flow path (35). Concurrently, this working fluid is further returned to oil tank (23) via hydraulic pump (22) to start the descent of elevator (27). In this way after the hydraulic pump (22) was forcedly rotated with this return oil, the inverter control aforementioned is implemented.

As described, by driving the motor, that is, the hydraulic pump before starting in the descent of the hydraulic elevator and by making the pressure inside the flow path below the control valve negative, the oil pump is allowed to act as an oil motor at the time of starting in descent. Moreover, because of lack of starting resistance of the motor, the characteristics of the control valve itself is exerted to give a smooth comfortableness to the ride at the start and more stability.

In following one example of energy conservation type hydraulic elevator of the invention will be illustrated.

EXAMPLE 1

FIG. 1 is one example of an energy conservation type hydraulic elevator of the invention. A communicating path (8) communicating respective cylinders (1)(6) of a main elevator (4) allowing main ram (3) attached with a cage (2) for carrying persons and/or burdens at its upper end to move up and down by flowing in or flowing-out the working fluid to or from main cylinder (1) and a balance elevator (7) consisting of a subram (13) unified with a fixed weight (5) and a subcylinder (6) is provided. A hydraulic circuit (12) including a hydraulic pump (10) driven by a motor (9) equipped with an inverter control device (not shown in the diagram), speed-adjusting valves (11)(11'), etc. is provided in the communicating path (8). Further, on the side of the main elevator of communicating path (8), an emergency descent valve (20) including a check valve discharging the working fluid on emergency is provided, and, on the side of balance elevator of communicating path (8), a modifying hydraulic pump (14) supplying the working fluid to subcylinder (6) is provided.

For the balance elevator (7), an adjusting weight (13) with about half of the maximum burden weight of main elevator (4) was further attached onto the fixed weight (5).

Besides, since the speed control valves (11), (11') have check valves respectively, they can compensate perfectly the stop positions of the respective elevators.

In the following, the working of an energy conservation type hydraulic elevator having such constitution will be explained.

I. Case of no Persons and no Carrying Burdens in the Cage of Main Elevator

In this case, the pressure on the side of balance elevator (7) becomes higher by a portion of load of adjusting weight. For ascending the main elevator at this time, the working fluid is flown into the communicating path (8) by allowing the balance elevator (7) to descend by its self-weight, the communicating path (8) is squeezed with the speed control valve (11') on the side of balance elevator (7), and the speed of working fluid in the subcylinder (6) on the side of higher pressure to flow into the main cylinder (1) on the side of lower pressure is controlled to ascend the main elevator (4). At this time, since the hydraulic pump (10) rotates concurrently, motor (9) is allowed to act as a generator and the rotational energy is recycled to inverter as a power to store or release.

Next, for descending the main elevator, the communicating path (8) is opened with the speed control valve (11) on the side of main elevator (4) and the hydraulic pump (10) is rotated to feed the working fluid in the main cylinder (1) on the side of lower pressure to the side of higher pressure under pressure. At this time, the pressure to be applied to the working fluid by hydraulic pump (10) is made to be a pressure not less than that corresponding to the weight of adjusting weight (13).

II. Case of Maximum Burden Weight (W) Being Added to the Cage of Main Elevator

In this case, the pressure on the side of main elevator (4) becomes higher by a portion of load of adjusting weight. First, for ascending the main elevator (4) at this time, the communicating path (8) is opened with the speed control valve (11') on the side of balance elevator (7) and the hydraulic pump (10) is rotated to feed the working fluid in the subcylinder (6) on the side of lower pressure into the main cylinder (1) on the side of higher pressure under pressure adding at least a pressure corresponding to the load of adjusting weight for ascending the main elevator (4).

Next, for descending the main elevator (4), the communicating path (8) is squeezed with the speed control valve (11) on the side of main elevator (4) to transport the working fluid from main cylinder (1) on the side of higher pressure to subcylinder (6) on the side of lower pressure by the descent of main elevator (4) by self-weight, thus controlling the speed while ascending balance elevator (7) as well as descending main elevator (4). Concurrently, the recycled power is accumulated in the inverter or returned to power source.

III. Effect on the Energy Conservation

Next, the effect on the energy conservation when using the balance elevator (7) based on this example was calculated. The weights of respective constitutional parts of the main elevator and the balance elevator, etc. are shown in Table 1.

TABLE 1

| | Ram diameter | Ram weight | Cage weight | Maximum burden weight | Weight of fixed weight | Weight of adjusting weight |
|---|---|---|---|---|---|---|
| Main elevator | 300 mm | 1,500 kg | 13,000 kg | 13,000 kg | — | — |
| Balance elevator | 350 mm | 2,000 kg | — | — | 19,580 kg | 7,000 kg |

First, the load to be added is always a sum of ram weight, weight of fixed weight and weight of adjusting weight in the balance elevator (7), hence, the static pressure generating in the subcylinder (6) becomes as indicated by equation (4), since the sectional area of cylinder is $(35/2)^2\pi = 961.6\ cm^2$.

$$\frac{2{,}000 + 19{,}580 + 7{,}000}{961.6} = 29.7\ kg/cm^2 \quad (4)$$

Next, when there are no burdens in the cage (2) of main elevator (4), that is, at the time of no load, the static pressure generating in the main cylinder (1) becomes as indicated by equation (5), since the sectional area of cylinder is $(30/2)^2\pi = 706.5\ cm^2$.

$$\frac{1{,}500 + 13{,}000}{706.56} = 20.5\ kg/cm^2 \quad (5)$$

Also, when the maximum burden weight (13,000 kg) is added to the main elevator (4), that is, at the time of full load, the static pressure generated in the main cylinder (1) becomes as indicated by equation (6).

$$\frac{1{,}500 + 13{,}000 + 13{,}000}{706.5} = 38.9\ kg/cm^2 \quad (6)$$

From above, the maximum difference generating in the main cylinder (1) and the subcylinder (6) can be determined. Actually, however, since there are resistances at the portions of motion (they were made to be $+3\ kg/cm^2$ on the ascent of cylinder and $-3\ kg/cm^2$ on the descent thereof in this example), the static pressures in foregoing (4), (5) and (6) come to differ on ascent and on descent of elevator one from another. As a result, the static pressures at the time of no load and at the time of full load become as shown in Table 2 and Table 3 below.

TABLE 2

| Motion of main-elevator | Static pressure in main cylinder at the time of no load | Static pressure in subcylinder | Pressure difference |
|---|---|---|---|
| Ascent | $20.5 + 3 = 23.5\ kg/cm^2$ | $29.7 - 3 = 26.7\ kg/cm^2$ | $3.2\ kg/cm^2$ |
| Descent | $20.5 - 3 = 17.5\ kg/cm^2$ | $29.7 - 3 = 32.7\ kg/cm^2$ | $15.2\ kg/cm^2$ |

TABLE 3

| Motion of main-elevator | Static pressure in main cylinder at the time of full load | Static pressure in subcylinder | Pressure difference |
|---|---|---|---|
| Ascent | 38.9 + 3 = 41.9 kg/cm$^2$ | 29.7 − 3 = 26.7 kg/cm$^2$ | 15.2 kg/cm$^2$ |
| Descent | 38.9 − 3 = 35.9 kg/cm$^2$ | 29.7 − 3 = 32.7 kg/cm$^2$ | 3.2 kg/cm$^2$ |

Figure 2:
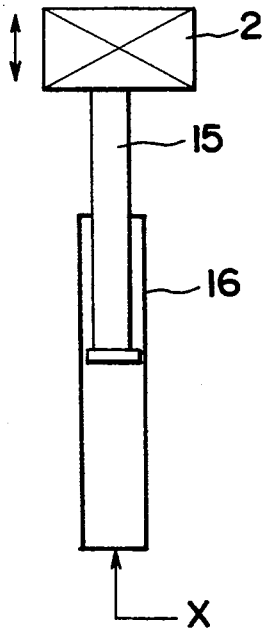
Fig. 2 (PRIOR ART)
FIG. 2 and FIG. 3 are illustration diagrams showing conventional examples.
Figure 3:
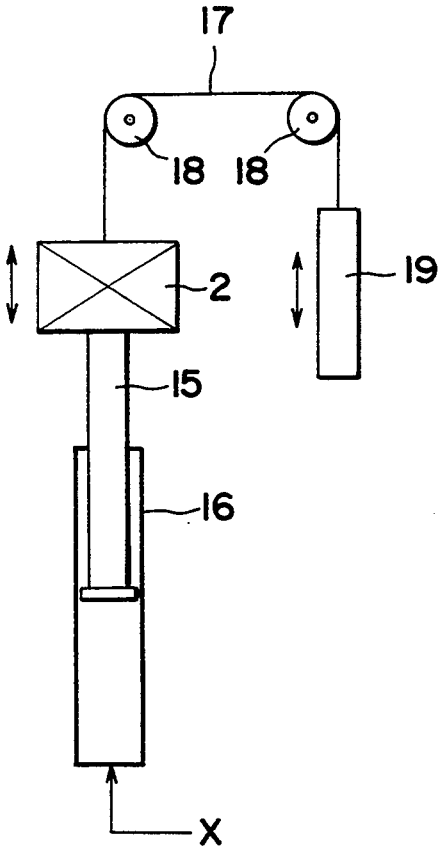
Fig. 3 (PRIOR ART)

From Table 2 and Table 3, the maximum difference of pressure is 15.2 kg/cm$^2$, which corresponds to the maximum horse power of motor (9). On the other hand, when installing no balance elevator (7), that is, in the case shown in FIG. 2, the horse power required for the motor corresponds to the static pressure on the ascent of main elevator (4) with full load and is 41.9 kg/cm from Table 3. If the speed for pushing up the ram with an outer diameter of 300 mm is the same, therefore, the consumption energy would decrease to 1/2.75 as shown in following equation $$\frac{15.2\ \text{kg/cm}^2}{41.9\ \text{kg/cm}^2} = \frac{1}{2.75}$$

Next, one example of the second invention will be illustrated based on drawings.

EXAMPLE 2

FIG. 4 shows a speed control device of a hydraulic elevator by means of an inverter power source.

The inverter control power source (31) and the inverter control device (33) drive the hydraulic pump (22) by controlling the number of revolutions of motor (21) and control the speed of elevator (27) unified with ram (25).

When elevator (27) ascends, the motor (21) increases the number of revolutions according to the command of operation pattern of inverter control device (33) and the hydraulic pump (22) combined with this is driven, thereby the working fluid is fed from oil tank (23) into cylinder (24) via hydraulic pump (22), flow path (35) and control valve (26). Also, conversely, by returning the working fluid to oil tank (23), the elevator (27) descends.

The control of operation pattern when hydraulic elevator (27) ascends or descends under the speed control of motor (21) is performed by inverter control device (33) (frequency-setting resistance, inverter control switches for ascent and descent, etc.), control switches (28) (sensors for detecting the level of hydraulic elevator etc.), inverter control power source (31) (acceleration and deceleration time-setting switches) and elevator (27) (switches in cage, etc.). Moreover, the damping resistance unit (32) is for releasing the power recycled from motor (21) to inverter control power source (31) as a thermal energy. This energy is effectively utilized for hot water supply, heating, etc. or discharged to the outdoors.

Explanation will be made about the ascending operation of elevator with such constitution.

Upon this ascending operation, the frequency, voltage, etc. of inverter control power source (31) are controlled by working inverter control device (33), switches inside and outside the cage of elevator (27), etc., thereby the number of revolutions of motor (21) is changed. First when motor (21) is operated, the hydraulic pump (22) connected to this rotates to generate a pressure on discharging side. Thus, the working fluid is fed from oil tank (23) into cylinder (24) to permit smooth accelerated ascent, full-speed ascent and decelerated stop.

Figure 6:
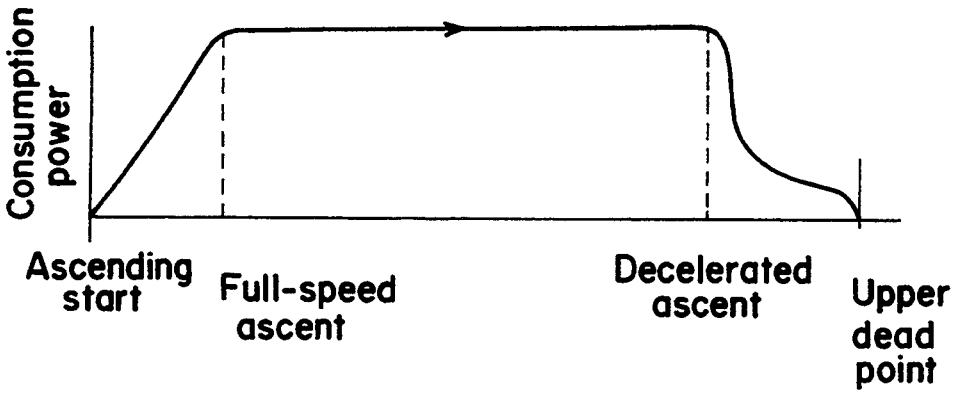
FIG. 6 is a chart showing the characteristic of power consumption at the time of hydraulic elevator moving up.

The relationship between power consumption on the input side of inverter control power source (31) and operation time at a given time is shown in FIG. 6. From the diagram, the power consumption increases or decreases approximately in proportion to the operation speed. So, there is an advantage that the fluctuation in voltage of distribution wire on the input side of inverter control power source (31) becomes drastically smaller over a conventional hydraulic elevator.

Next, when the elevator descends, the number of revolutions of motor (21) is controlled by inverter control similarly to the time of said ascent, but the following actions are taken before inverter control as above.

Namely, immediately before starting the descent from a stopped state of elevator (27), the motor (21) is driven for a little time and the hydraulic pump (22) is rotated so as the working fluid in flow path (35) is returned to oil tank (23), then the power source of motor (21) is switched-off. At this time, since the motor (21) rotates by the inertial force even after switching-off of power source, the pressure inside the flow path (35) becomes negative and the working fluid circulates through hydraulic pump (22), oil tank (23) and nonreturn valve (36). The pressure inside the flow path (35) during this time approaches a given negative pressure as indicated by the lapse of time between A and B in FIG. 5.

Figure 5:
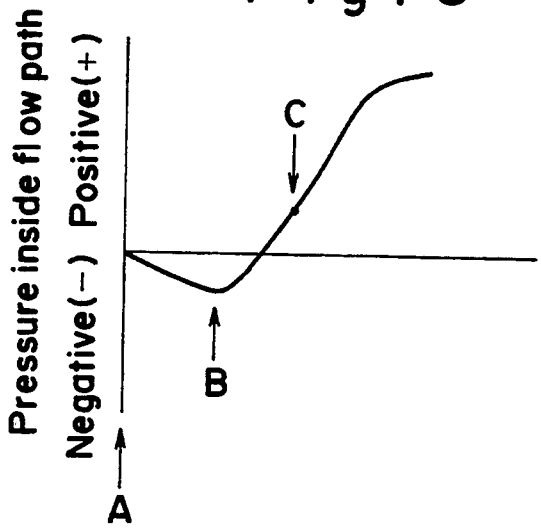
FIG. 5 is a chart illustrating the control method of the invention.

Thereafter, at an arbitrary point B in FIG. 5, control valve (26) is worked and electromagnetic valve $S_2$ is opened by pilot $S_1$, thereby the working fluid in cylinder (24) is supplied gradually to flow path (35) and returned to oil tank (23) through hydraulic pump (22). By doing so, the pressure inside the flow path (35) turns to rise as shown in FIG. 5 and, with an increase in the opening of control valve (26), the pressure inside the flow path (35) also increases. And, at a point C in FIG. 5, the motor (21) rotates by the inverter power source (31) at a number of revolutions at which the hydraulic pump (22) is forcedly rotated with return oil, that is, the motor (21) is rotated at that time to control the speed as conventional one. Besides, the number of revolutions of motor (21) is always monitored with a detector of number of revolutions connected to the inverter control power source (31).

As described, in accordance with the first invention, such remarkable effects that a hydraulic elevator saving the space and being advantageous also for layout can be provided and further that this is of energy conservation type requiring lower power and lower installation power and exertion.

Moreover, in accordance with the second invention, a conspicuous effect permitting the provision of elevator comfortable to ride in can be exerted, since smooth operation of the elevator is possible upon starting descent of the hydraulic elevator.

What is claimed is:

1. An energy conservation type hydraulic elevator comprising:

a main elevator having a main cylinder and a main ram mounted with a cage for carrying a load having a burden weight in a range between a minimum burden weight and a maximum burden weight;

a balance elevator having a subcylinder and a subram mounted with a fixed weight;

a communicating path fluidically communicating said main cylinder and said subcylinder to allow working fluid to flow in or flow out of said main cylinder to move said main elevator up and down;

a first hydraulic pump located in said communicating path such that said first hydraulic pump is in communication with said main cylinder and said subcylinder for selectively pumping working fluid in a first direction in which working fluid is pumped from said subcylinder to said main cylinder and in a second direction in which working fluid is pumped from said main cylinder to said subcylinder;

an adjusting weight with about half of said maximum burden weight provided on said fixed weight;

an emergency descent valve discharging working fluid to the communicating path between said first hydraulic pump and said main cylinder;

a second hydraulic pump connected to said communicating path and connected to a working fluid supply for modifying the relative positions of said main cylinder and said subcylinder by pumping additional working fluid from said working fluid supply into the communication path at a location between said balance elevator and said first hydraulic pump; and a device for inverter-controlling a motor for driving said first hydraulic pump.

2. An energy conservation type hydraulic elevator comprising:

a main elevator having a main cylinder and a main ram mounted with a cage for carrying a load;

a balance elevator having a subcylinder and a subram;

a fluid path in communication with both of said main cylinder and said subcylinder;

a first pump located along said fluid path, wherein said first pump can be driven by a motor and by fluid pressure in said fluid path, wherein when said first pump is driven by a motor, said first pump increases hydraulic pressure in at least a portion of said fluid path;

wherein when said first pump is driven by fluid in said fluid path, said pump extracts power from said fluid;

wherein a three-phase motor is connected to said first pump, said three-phase motor acting as driving means driving said first pump to increase hydraulic pressure in at least a portion of said fluid path, said three-phase motor also acting as power generating means for generating power such that when said first pump is driven by fluid in said fluid path, said first pump drives said three-phase motor as a generator; and the energy conservation elevator further including a second pump communicating with said fluid path, said second pump connected to said fluid path at a location between the first pump and the subcylinder.

3. The energy conservation elevator of claim 2, wherein said main elevator has a specified maximum burden weight, and wherein said balance elevator includes a fixed weight and an adjusting weight and wherein said adjusting weight is approximately one-half of the maximum burden weight of the main elevator.

4. The energy conservation elevator of claim 2, further including a first speed control valve disposed along said fluid path between said main cylinder and said pump, and a second speed control valve disposed along said fluid path between said subcylinder and said first pump.

5. An energy conservation type hydraulic elevator comprising:

a main elevator having a main cylinder and a main ram;

a balance elevator having a subcylinder and a subram;

a fluid path communicating with both of said main cylinder and said subcylinder;

pumping and generating means disposed along said fluid path for operating in a pumping mode and in a generating mode, wherein in a pumping mode, said pumping and generating means pumps hydraulic fluid located in said fluid path, and in a generating mode, said pumping and generating means extracts power from said fluid, said pumping and generating means including a first pump; and a second pump connected to said fluid path at a location between said pumping and generating means and said subcylinder.

6. The energy conservation elevator of claim 5, wherein said first pump extracts power in the form of rotational energy produced as said first pump is rotated by hydraulic fluid in the generating mode.

7. The energy conservation elevator of claim 5, wherein said first pump includes a hydraulic pump, and wherein said hydraulic pump is connected to a three-phase motor.

8. The energy conservation elevator of claim 5, wherein said balance elevator includes a fixed weight and an adjusting weight, said adjusting weight being approximately one-half a maximum burden weight of the main elevator.

9. The energy conservation elevator of claim 1, further including a first speed control valve located along said communication path and between said main cylinder and said first hydraulic pump, and a second speed control valve located between said subcylinder and said first hydraulic pump, said first and second speed control valves having respective first and second check valves associated therewith.

10. A hydraulic elevator comprising:

an elevator having a main cylinder and a main ram mounted with a cage for carrying a load;

a fluid path for supplying fluid to said main cylinder and for removing fluid from said main cylinder;

pumping means connected to said fluid path for pumping fluid through said fluid path to said main cylinder to cause said elevator to ascend and for being driven by said fluid when fluid is exiting said main cylinder for descending said main elevator;

a valve disposed along said fluid path between said pumping means and said main cylinder;

a motor connected to said pump, with an inverter control connected to said motor; and means for creating a negative pressure in a portion of said flow path on a pumping means side of said valve prior to an opening of said valve for carrying out a descending operation of said elevator.

11. The elevator of claim 10, wherein said means for creating a negative pressure includes control means for operating said pump to create said negative pressure while said valve is closed.

12. The elevator of claim 11, wherein said control means operates said pump to create said negative pressure in said portion of said flow path prior to opening of said valve, and thereafter said control means ceases operation of said pump, with the ceasing of operation of said pump also occurring prior to opening of said valve for carrying out a descending operation.

* * * * *